US011769657B2

(12) United States Patent
Johannessen et al.

(10) Patent No.: US 11,769,657 B2
(45) Date of Patent: Sep. 26, 2023

(54) DUAL TAPPED INDUCTOR BOOST TOPOLOGY FOR DIGITAL CONTROL OF AN EXCIMER LAMP

(71) Applicant: B/E AEROSPACE, INC., Winston Salem, NC (US)

(72) Inventors: Eric Johannessen, Holbrook, NY (US); Jeremy Fredrich, West Allis, WI (US)

(73) Assignee: B/E AEROSPACE, INC., Winston Salem, NC (US)

( * ) Notice: Subject to any disclaimer, the term of this patent is extended or adjusted under 35 U.S.C. 154(b) by 126 days.

(21) Appl. No.: 17/371,574

(22) Filed: Jul. 9, 2021

(65) Prior Publication Data

US 2023/0010506 A1 Jan. 12, 2023

(51) Int. Cl.
*H05B 41/14* (2006.01)
*H01J 65/04* (2006.01)

(52) U.S. Cl.
CPC ..... *H01J 65/042* (2013.01); *H05B 41/14* (2013.01)

(58) Field of Classification Search
CPC ..... H01J 65/042; H05B 41/14
See application file for complete search history.

(56) References Cited

U.S. PATENT DOCUMENTS 6,356,033 B1 3/2002 Okamoto et al.
2003/0085669 A1* 5/2003 Pak ..... H05B 41/36 315/276
2007/0115088 A1* 5/2007 Sugioka ..... H05B 41/2806 336/232
2012/0194070 A1* 8/2012 Tao ..... H05B 41/24 315/34

FOREIGN PATENT DOCUMENTS

JP 2004031058 1/2004

OTHER PUBLICATIONS

European Patent Office, European Search Report dated Dec. 16, 2022 in Application No. 22181934.5.

* cited by examiner

*Primary Examiner* — Henry Luong
(74) *Attorney, Agent, or Firm* — SNELL & WILMER L.L.P.

(57) ABSTRACT

A system for powering an excimer bulb includes a first inductor configured to be coupled to a first terminal of the excimer bulb. The system further includes a first transistor coupled to the first inductor and having an on state configured to allow current to flow through the first inductor and an off state. The system further includes a second transistor configured to be coupled to the first terminal of the excimer bulb and having an on state configured to allow current to flow through the excimer bulb and an off state. The system further includes a controller coupled to the first transistor and the second transistor, and to control operation of the first transistor and the second transistor to power the excimer bulb.

14 Claims, 2 Drawing Sheets

DUAL TAPPED INDUCTOR BOOST TOPOLOGY FOR DIGITAL CONTROL OF AN EXCIMER LAMP

FIELD

The present disclosure relates to systems and methods for powering excimer lamps and, more particularly, to a push-pull balanced driver for powering excimer lamps.

BACKGROUND

Ultraviolet (UV) light has been found to be an effective disinfectant. Of the various UV wavelengths, 222 nanometers (222 nm) has been found to be particularly promising (effective and safe for humans in moderate doses). Currently, UV lights that emit light of this wavelength are only available as gas-discharge excimer lamps. These excimer lamps may degrade over time, resulting in changing electrical characteristics. Furthermore, different excimer lamps may be formed with different electrical characteristics and may operate at different temperatures. These excimer lamps may be used on aircraft, where it is desirable to reduce a total weight and area of the related power supply.

SUMMARY

Disclosed herein is a system for powering an excimer bulb. The system includes a first inductor configured to be coupled to a first terminal of the excimer bulb. The system further includes a first transistor coupled to the first inductor and having an on state configured to allow current to flow through the first inductor and an off state. The system further includes a second transistor configured to be coupled to the first terminal of the excimer bulb and having an on state configured to allow current to flow through the excimer bulb and an off state. The system further includes a controller coupled to the first transistor and the second transistor, and to control operation of the first transistor and the second transistor to power the excimer bulb.

Any of the foregoing embodiments may further include: a first resistor coupled between the first transistor and an electrical ground; and a second resistor coupled between the second transistor and the electrical ground, wherein the controller is further coupled to the first resistor and the second resistor and is further configured to control operation of the first transistor and the second transistor based on electrical properties detected at the first resistor and the second resistor.

Any of the foregoing embodiments may further include: a second inductor configured to be coupled to a second terminal of the excimer bulb; a third transistor coupled to the second inductor and having an on state configured to allow current to flow through the second inductor and an off state; a fourth transistor configured to be coupled to the second terminal of the excimer bulb and having an on state configured to allow current to flow through the excimer bulb and an off state, wherein the controller is further coupled to the third transistor and the fourth transistor, and to control operation of the third transistor and the fourth transistor to power the excimer bulb.

In any of the foregoing embodiments, the controller is configured to cause the system to power the excimer bulb both symmetrically and asymmetrically.

Any of the foregoing embodiments may further include: a third resistor coupled between the third transistor and the electrical ground; and a fourth resistor coupled between the fourth transistor and the electrical ground, wherein the controller is further coupled to the third resistor and the fourth resistor and is further configured to control operation of the third transistor and the fourth transistor based on electrical properties detected at the third resistor and the fourth resistor.

In any of the foregoing embodiments, the controller is further configured to control a ramp rate, a duty cycle, a frequency, and an amplitude of power provided to the excimer bulb by controlling operation of the first transistor, the second transistor, the third transistor, and the fourth transistor.

In any of the foregoing embodiments, the excimer bulb is configured to operate in a first stage in which the first terminal and the second terminal are charged, a second stage in which an arc is formed from the first terminal to the second terminal, and a third stage in which the excimer bulb discharges, and wherein the controller is further configured to control operation of the first transistor, the second transistor, the third transistor, and the fourth transistor to control an amount of time the excimer bulb is in the first stage, the second stage, and the third stage.

In any of the foregoing embodiments, the first transistor and the second transistor each include at least one of gallium nitride or silicon carbide.

In any of the foregoing embodiments, the first transistor and the second transistor are each N-channel metal oxide semiconductor field effect transistors (MOSFETs).

In any of the foregoing embodiments, the excimer bulb is configured to generate light having a wavelength between 200 and 250 nanometers (0.0079 thousandths of an inch, or mils, and 0.0098 mils).

Also disclosed is a system for powering an excimer bulb. The system includes a first circuit configured to provide power to a first terminal of the excimer bulb. The system further includes a second circuit configured to provide power to a second terminal of the excimer bulb. The system further includes a controller coupled to the first circuit and the second circuit and configured to control operation of the first circuit and the second circuit to power the excimer bulb.

In any of the foregoing embodiments, the first circuit includes: a first inductor configured to be coupled to the first terminal of the excimer bulb; a first transistor coupled to the first inductor and having an on state configured to allow current to flow through the first inductor and an off state; and a second transistor configured to be coupled to the first terminal of the excimer bulb and having an on state configured to allow current to flow through the excimer bulb and an off state, wherein the controller is coupled to the first transistor and the second transistor and is configured to power the excimer bulb by controlling operation of the first transistor and the second transistor.

In any of the foregoing embodiments, the first circuit further includes: a first resistor coupled between the first transistor and an electrical ground; and a second resistor coupled between the second transistor and the electrical ground, wherein the controller is further coupled to the first resistor and the second resistor and is further configured to control operation of the first transistor and the second transistor based on electrical properties detected at the first resistor and the second resistor.

In any of the foregoing embodiments, the second circuit includes: a second inductor configured to be coupled to the second terminal of the excimer bulb; a third transistor coupled to the second inductor and having an on state configured to allow current to flow through the second inductor and an off state; a fourth transistor configured to be coupled to the second terminal of the excimer bulb and having an on state configured to allow current to flow through the excimer bulb and an off state, wherein the controller is further coupled to the third transistor and the fourth transistor, and to control operation of the third transistor and the fourth transistor to power the excimer bulb.

In any of the foregoing embodiments, the second circuit further includes: a third resistor coupled between the third transistor and the electrical ground; and a fourth resistor coupled between the fourth transistor and the electrical ground, wherein the controller is further coupled to the third resistor and the fourth resistor and is further configured to control operation of the third transistor and the fourth transistor based on electrical properties detected at the third resistor and the fourth resistor.

In any of the foregoing embodiments, the controller is further configured to control a ramp rate, a duty cycle, a frequency, and an amplitude of power provided to the excimer bulb by controlling operation of the first transistor, the second transistor, the third transistor, and the fourth transistor.

In any of the foregoing embodiments, the excimer bulb is configured to operate in a first stage in which the first terminal and the second terminal are charged, a second stage in which an arc is formed from the first terminal to the second terminal, and a third stage in which the excimer bulb discharges, and wherein the controller is further configured to control operation of the first transistor, the second transistor, the third transistor, and the fourth transistor to control an amount of time the excimer bulb is in the first stage, the second stage, and the third stage.

In any of the foregoing embodiments: the first transistor and the second transistor are each N-channel metal oxide semiconductor field effect transistors (MOSFETs); and the first transistor and the second transistor each include at least one of gallium nitride or silicon carbide.

In any of the foregoing embodiments, the excimer bulb is configured to generate light having a wavelength between 200 and 250 nanometers (0.0079 thousandths of an inch, or mils, and 0.0098 mils).

Also disclosed is a system for powering an excimer bulb. The system includes a first circuit having: a first inductor configured to be coupled to a first terminal of the excimer bulb, a first transistor coupled to the first inductor and having an on state configured to allow current to flow through the first inductor and an off state, and a second transistor configured to be coupled to the first terminal of the excimer bulb and having an on state configured to allow current to flow through the excimer bulb and an off state. The system further includes a second circuit having: a second inductor configured to be coupled to a second terminal of the excimer bulb, a third transistor coupled to the second inductor and having an on state configured to allow current to flow through the second inductor and an off state, and a fourth transistor configured to be coupled to the second terminal of the excimer bulb and having an on state configured to allow current to flow through the excimer bulb and an off state. The system further includes a controller coupled to the first transistor, the second transistor, the third transistor, and the fourth transistor and configured to control operation of the first transistor, the second transistor, the third transistor, and the fourth transistor to power the excimer bulb.

Any of the foregoing embodiments may further include: a first resistor coupled between the first transistor and an electrical ground; and a second resistor coupled between the second transistor and the electrical ground, wherein the controller is further coupled to the first resistor and the second resistor and is further configured to control operation of the first transistor and the second transistor based on electrical properties detected at the first resistor and the second resistor.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

Figure 1:
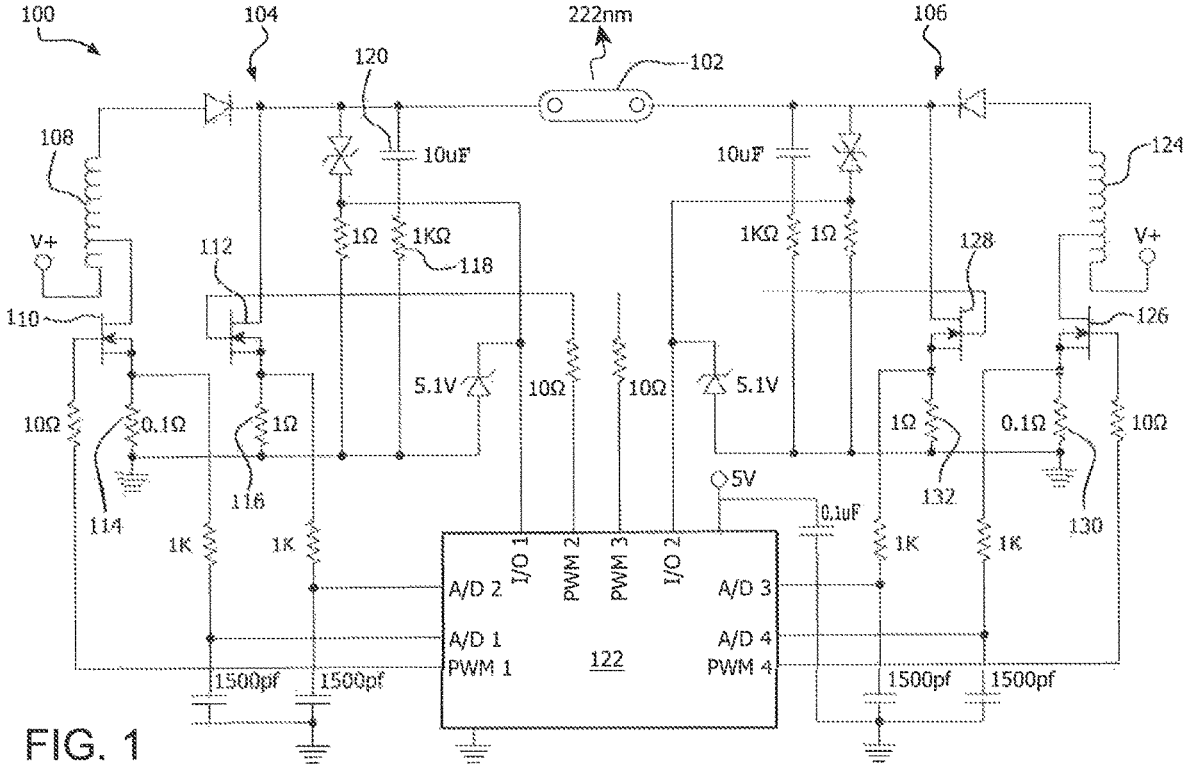
FIG. 1 illustrates a system for providing power to an excimer lamp, in accordance with various embodiments.

The detailed description of exemplary embodiments herein makes reference to the accompanying drawings, which show exemplary embodiments by way of illustration. While these exemplary embodiments are described in sufficient detail to enable those skilled in the art to practice the exemplary embodiments of the disclosure, it should be understood that other embodiments may be realized and that logical changes and adaptations in design and construction may be made in accordance with this disclosure and the teachings herein. Thus, the detailed description herein is presented for purposes of illustration only and not limitation. The steps recited in any of the method or process descriptions may be executed in any order and are not necessarily limited to the order presented.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

The present disclosure discloses a dual tapped inductor driver for powering an excimer lamp, such as an excimer lamp that outputs light having a wavelength designed to injure, kill, or destroy pathogens. For example, the wavelength may be between 200 and 250 nanometers (0.0079 thousandths of an inch, or mils, and 0.0098 mils), between 220 and 225 nanometers (0.0087 mils and 0.0088 mils), or about 222 nanometers (0.0087 mils). Where used in this context, "about" refers to the referenced value plus or minus 2 percent of the referenced value. The driver may provide push-pull balanced drive from a single-ended, low-cost, and relatively small components. These features are desirable as the driver may be located on an aircraft, where weight and space are at a premium. The driver of the present disclosure may be a non-isolated technology that avoids or reduces leakage inductance issues with transformers and allows all components to be simple ground referenced (i.e., all N-channel metal oxide semiconductor field effect transistors (MOSFETs), microcontrollers, and sensors may be simple ground referenced). A microcontroller may provide full digital control of the operating characteristics and protection features, thus providing ideal power signals to the excimer lamps.

Conventional driver topologies are transformer-based, which reduces efficiency and control, and are relatively large in size and weight (relative to the driver of the present disclosure). Without the control, these conventional drivers tend to fail to provide a soft ramp-up, fail to provide protection, and fail to provide current and voltage control. The small size of the driver disclosed herein allows for point-of-load and point-of-use applications mounded directly to the lamp, thus saving weight, reducing cable usage, and improving safety.

Referring now to FIG. 1, a system 100 for providing power to an excimer lamp 102 is shown. The system 100 may include a first circuit 104 coupled to a first terminal of the excimer lamp 102 and a second circuit 106 coupled to a second terminal of the excimer lamp 102. The first circuit 104 and the second circuit 106 may be mirror images of each other, and may together provide a push-pull power signal to the excimer lamp 102. Although various values for the electrical components (e.g., resistance values for resistors and capacitance values for capacitors) are shown, they are for illustrative purposes only, and one skilled in the art will realize that the scope of the present disclosure is not limited by the electrical values provided herein.

Excimer lamps may operate in three stages: (1) electrodes or terminals of the lamp 102 may be charged; (2) an arc is formed across the excimer lamp 102; and (3) a discharge occurs across the lamp 102. It is desirable to control the parameters during each of these three stages, and the system 100 accomplishes this goal. The first circuit 104 may include a first inductor 108 that is coupled to the first terminal of the excimer lamp 102. The inductor 108 may be charged to create the charging of the terminals of the lamp 102 (i.e., stage 1).

The first circuit 104 may further include a first transistor 110 coupled to the inductor 108. The first transistor 110 may include an on state in which current may flow through the first inductor and may further include an off state to prevent such current flow. The first circuit 104 may also include a second transistor 112 that is coupled to the first terminal of the excimer bulb. The second transistor 112 may also include an on state in which current may flow through the excimer bulb and an off state to prevent such current flow.

The first circuit 104 may also include a first resistor 114 in series with the first transistor 110, and a second resistor 116 in series with the second transistor 112. As will be discussed in further detail below, a controller 122 may be coupled to the first resistor 114 and the second resistor 116 and may detect electrical properties of the first resistor 114 and the second resistor 116 based on such coupling. The controller 122 may include a logic device such as one or more of a central processing unit (CPU), an accelerated processing unit (APU), a digital signal processor (DSP), a field programmable gate array (FPGA), an application specific integrated circuit (ASIC), or any other device capable of implementing logic. In various embodiments, the controller 122 may further include any non-transitory memory known in the art. The memory may store instructions usable by the logic device to perform operations as described herein.

The second circuit 106 may include a second inductor 124 that is coupled to the second terminal of the excimer lamp 102. The second inductor 124 may be charged to create the charging of the terminals of the lamp 102 (i.e., stage 1 above).

The second circuit 106 may further include a third transistor 126 coupled to the inductor 124. The third transistor 126 may include an on state in which current may flow through the second inductor 124 and may further include an off state to prevent such current flow. The second circuit 106 may also include a fourth transistor 128 that is coupled to the second terminal of the excimer lamp 102. The fourth transistor 128 may also include an on state in which current may flow through the excimer bulb and an off state to prevent such current flow.

The second circuit 106 may also include a third resistor 130 in series with the third transistor 126, and a fourth resistor 132 in series with the fourth transistor 128. As will be discussed in further detail below, the controller 122 may be coupled to the third resistor 130 and the fourth resistor 132 and may detect electrical properties of the third resistor 130 and the fourth resistor 132 based on such coupling.

As referenced above, the controller 122 may be coupled to and receive electrical signals from the first resistor 114, the second resistor 116, the third resistor 130, and the fourth resistor 132. The controller 122 may receive, for example, a current or voltage signal indicating a current or a voltage of the respective resistor. The controller 122 may likewise be coupled to each of the transistors 110, 112, 126, 128 and may control operation of the transistors 110, 112, 126, 128 based on the currently detected electrical properties of the resistors 114, 116, 130, 132. In particular, the controller 122 may detect or determine electrical properties that indicate in which of the three stages the system 100 is operating, and further indicate a current status of the excimer lamp 102. Based on this detected information (and based on desirable operation of the excimer lamp 102), the controller 122 may control operation of the transistors 110, 112, 126, 128 to achieve the desired operation of the excimer lamp 102. For example, the current through the first resistor 114 may corresponding to an amount of charge that the first inductor 108 is receiving during the charging stage, and the current through the second resistor 116 may correspond to an amount of current flowing through the excimer lamp 102 during the discharge stage.

As opposed to conventional drivers, the system 100 may be used to control various characteristics of the excimer lamp 102 through all three stages. In particular, the controller 122 may control a ramp rate, a duty cycle, a frequency, and an amplitude of power provided to the excimer lamp 102 by controlling operation of the transistors 110, 112, 126, 128 based on the detected electrical properties. In addition, the system 100 may be used to drive multiple types of lamps or bulbs, again which conventional drivers are incapable of achieving. The system 100 may drive the excimer lamp 102 in either a symmetrical or non-symmetrical fashion. The controller 122 may further control power modulation in order to adjust a brightness of the light from the excimer lamp 102. The transistors 110, 112, 126, 128 may be formed using at least one of gallium nitride or silicon carbide and may be low-side N-channel MOSFETS.

The ability for the controller 122 to detect or measure the currents through the resistors 114, 116, 130, 132 allows it to calculate or determine the current flowing through the excimer lamp 102, the boost stage currents, and voltage measurements for breakdown and excitation voltage with respect to a common ground reference. The system 100 provides a dual-tapped inductor boost circuit, which allows for control of the excitation of both poles across the excimer lamp 102 rather than allowing one pole of the excimer lamp to be passive or reflexive (as with conventional drivers).

The controller 122 is designed to have relatively simple interfaces which allows for controlled timing and ramp rate of boosts for ideal strike voltage as well as controlled steady-state operation. Reverse recovery diodes do not require a high voltage rating because they are only protecting against the negative turns ratio voltage during boost charge, and forward conduct during the discharge mode.

Resistance and capacitance (RC) combinations (i.e., the resistor 118 and the capacitor 120, along with the corresponding RC components on the second circuit 106) have been added for ramp rate control to set a rise time of the boost. The primary switching transistors 110, 126 are low-side and are protected from excessive voltage by turns ratio, avoiding a high-voltage part requirement. The sinking transistors 112, 128 may have a slower response rate than the primary switching transistors 110, 126, and may both be turned on together to cause the voltage across the excimer lamp 102 to be zero in order to reset the lamp 102 or make the system 100 safe for handling. In various embodiments, it may be desirable for the primary switching transistors 110, 126 to be GaN-based, and the sinking transistors 112, 128 to be SiC due to the relatively high voltages experienced therein.

The topology of the system 100 leads to a relatively low-cost, safe, and balanced driver that can control all parameters of excimer drive (i.e., strike voltage, ramp rate, current, on-time, duty cycle, etc.). This allows aging, temperature, and other compensation to a relatively vast array of lamp types (i.e., the system 100 may be a universal solution as a driver for driving lamps).

On request demand, the controller 122 may begin alternating the pairs transistors 110, 112, 126, 128 for progressively longer pulses. This results in gradual increase of the amount of boost voltage applied to the terminals of the excimer lamp 102 until the arc strike is initiated. The ramp rate of the strike voltage may be sufficiently fast to cause the arc discharge to form, otherwise the result may be charging the lamp 102 capacitance model with an excessive voltage and the resulting eventual discharge may degrade aging performance of the lamp 102.

Once the arc strike forms, it ionizes the krypton and chlorine (KrCl) gas in the lamp 102 and results in a plasma state for current conduction. As the arc conducts, the current-source nature of the tapped inductor 108, 124 helps to sustain the arc without over-voltage and degradation of the lamp. After the plasma state is reached, successive bipolar strikes between the boost stages can be at a lower voltage if the plasma remains in an excited conductive state. This control of both contacts of the lamp 102 theoretically allows ideal current-driven longer duration arcs on both phases and improves lamp efficacy. The avoidance of excessive strike voltage is thought to idealize lamp aging, and the current source nature of the boost inductors adapts to changes in capacitance or other lamp properties over temperature and age.

The controller 122 may measure the current through each half-wave of operation with the sense resistors 116, 132 in the base of the sinking transistors 112, 128. This allows the controller 122 to confirm the presence of an arc along with the operational currents relating to the implied intensity. Using this information, and perhaps temperature feedback, the controller 122 may adjust the amount of drive current and the frequency for a given operating mode.

Figure 2:
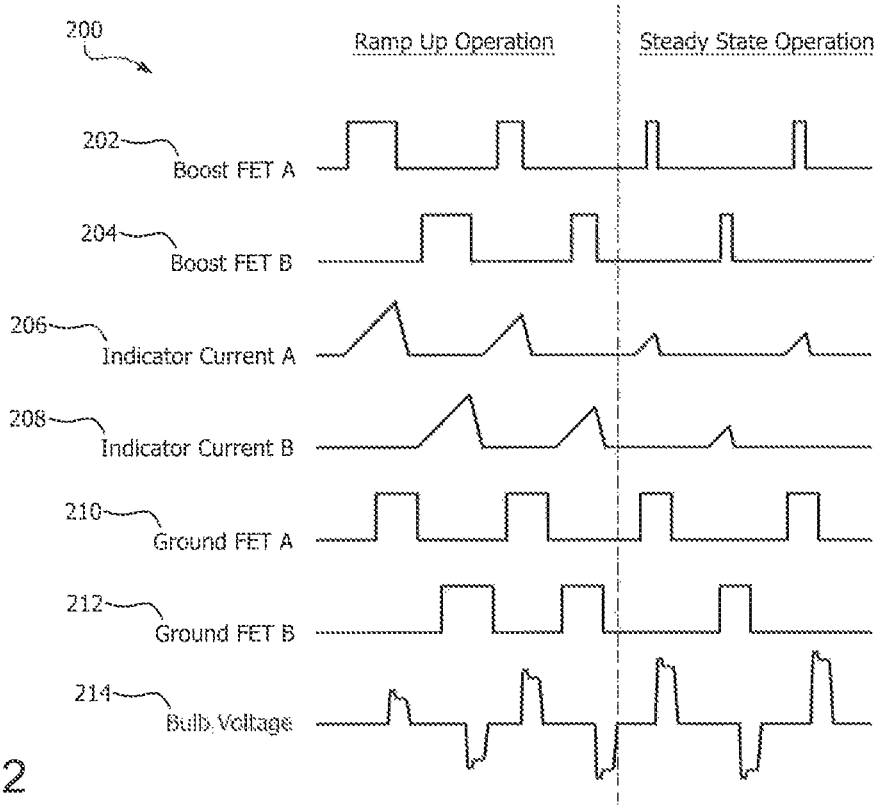
FIG. 2 is a chart illustrating operation of the system of FIG. 1, in accordance with various embodiments.

Referring now to FIGS. 1 and 2, operation of the system 100 of FIG. 1 is shown. In particular, a chart 200 illustrating current values of the various components during a ramp-up period 201 and during steady state operation 203 is shown. The chart 200 illustrates current 202 through the boost transistor 112 and the boost transistor 128, current through the resistor 116 and the resistor 132, through the ground transistor 110 and the ground transistor 126, and the voltage across the excimer lamp 102.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A system for powering an excimer bulb, the system comprising:

a first inductor configured to be coupled to a first terminal of the excimer bulb;

a first transistor coupled to the first inductor and having an on state configured to allow current to flow through the first inductor and an off state;

a second transistor configured to be coupled to the first terminal of the excimer bulb and having an on state configured to allow current to flow through the excimer bulb and an off state;

a first resistor coupled between the first transistor and an electrical ground;

a second resistor coupled between the second transistor and the electrical ground;

a second inductor configured to be coupled to a second terminal of the excimer bulb;

a third transistor coupled to the second inductor and having an on state configured to allow current to flow through the second inductor and an off state;

a fourth transistor configured to be coupled to the second terminal of the excimer bulb and having an on state configured to allow current to flow through the excimer bulb and an off state; and a controller coupled to the first transistor, the second transistor, the third transistor, and the fourth transistor to control operation of at least one of the first transistor, the second transistor, the third transistor, and the fourth transistor to power the excimer bulb;

wherein the controller is further coupled to the first resistor and the second resistor and is further configured to control operation of the first transistor and the second transistor based on electrical properties detected at the first resistor and the second resistor.

2. The system of claim 1, wherein the controller is configured to cause the system to power the excimer bulb both symmetrically and asymmetrically.

3. The system of claim 1, further comprising:

a third resistor coupled between the third transistor and the electrical ground; and a fourth resistor coupled between the fourth transistor and the electrical ground, wherein the controller is further coupled to the third resistor and the fourth resistor and is further configured to control operation of the third transistor and the fourth transistor based on electrical properties detected at the third resistor and the fourth resistor.

4. The system of claim 1, wherein the excimer bulb is configured to operate in a first stage in which the first terminal and the second terminal are charged, a second stage in which an arc is formed from the first terminal to the second terminal, and a third stage in which the excimer bulb discharges, and wherein the controller is further configured to control operation of the first transistor, the second transistor, the third transistor, and the fourth transistor to control an amount of time the excimer bulb is in the first stage, the second stage, and the third stage.

5. The system of claim 1, wherein the first transistor and the second transistor each include at least one of gallium nitride or silicon carbide.

6. The system of claim 1, wherein the first transistor and the second transistor are each N-channel metal oxide semiconductor field effect transistors (MOSFETs).

7. The system of claim 1, wherein the excimer bulb is configured to generate light having a wavelength between 200 and 250 nanometers (0.0079 thousandths of an inch, or mils, and 0.0098 mils).

8. A system for powering an excimer bulb, the system comprising:

a first circuit configured to provide power to a first terminal of the excimer bulb;

a second circuit configured to provide power to a second terminal of the excimer bulb; and a controller coupled to the first circuit and the second circuit and configured to control operation of the first circuit and the second circuit to power the excimer bulb;

wherein the first circuit includes:

a first inductor configured to be coupled to the first terminal of the excimer bulb;

a first transistor coupled to the first inductor and having an on state configured to allow current to flow through the first inductor and an off state;

a second transistor configured to be coupled to the first terminal of the excimer bulb and having an on state configured to allow current to flow through the excimer bulb and an off state;

a first resistor coupled between the first transistor and an electrical ground; and a second resistor coupled between the second transistor and the electrical ground;

wherein the second circuit includes:

a second inductor configured to be coupled to the second terminal of the excimer bulb;

a third transistor coupled to the second inductor and having an on state configured to allow current to flow through the second inductor and an off state; and a fourth transistor configured to be coupled to the second terminal of the excimer bulb and having an on state configured to allow current to flow through the excimer bulb and an off state;

wherein the controller is coupled to the first transistor, the second transistor, the third transistor, and the fourth transistor and is configured to power the excimer bulb by controlling operation of the first transistor, the second transistor, the third transistor, and the fourth transistor;

wherein the controller is further coupled to the first resistor and the second resistor and is further configured to control operation of the first transistor and the second transistor based on electrical properties detected at the first resistor and the second resistor.

9. The system of claim 8, wherein the second circuit further includes:

a third resistor coupled between the third transistor and the electrical ground; and a fourth resistor coupled between the fourth transistor and the electrical ground, wherein the controller is further coupled to the third resistor and the fourth resistor and is further configured to control operation of the third transistor and the fourth transistor based on electrical properties detected at the third resistor and the fourth resistor.

10. The system of claim 8, wherein the controller is further configured to control a ramp rate, a duty cycle, a frequency, and an amplitude of power provided to the excimer bulb by controlling operation of the first transistor, the second transistor, the third transistor, and the fourth transistor.

11. The system of claim 8, wherein the excimer bulb is configured to operate in a first stage in which the first terminal and the second terminal are charged, a second stage in which an arc is formed from the first terminal to the second terminal, and a third stage in which the excimer bulb discharges, and wherein the controller is further configured to control operation of the first transistor, the second transistor, the third transistor, and the fourth transistor to control an amount of time the excimer bulb is in the first stage, the second stage, and the third stage.

12. The system of claim 8, wherein:

the first transistor and the second transistor are each N-channel metal oxide semiconductor field effect transistors (MOSFETs); and the first transistor and the second transistor each include at least one of gallium nitride or silicon carbide.

13. The system of claim 8, wherein the excimer bulb is configured to generate light having a wavelength between 200 and 250 nanometers (0.0079 thousandths of an inch, or mils, and 0.0098 mils).

14. A system for powering an excimer bulb, the system comprising:

a first circuit having:

a first inductor configured to be coupled to a first terminal of the excimer bulb, a first transistor coupled to the first inductor and having an on state configured to allow current to flow through the first inductor and an off state, a second transistor configured to be coupled to the first terminal of the excimer bulb and having an on state configured to allow current to flow through the excimer bulb and an off state, a first resistor coupled between the first transistor and an electrical ground, and a second resistor coupled between the second transistor and the electrical ground;

a second circuit having:

a second inductor configured to be coupled to a second terminal of the excimer bulb, a third transistor coupled to the second inductor and having an on state configured to allow current to flow through the second inductor and an off state, and a fourth transistor configured to be coupled to the second terminal of the excimer bulb and having an on state configured to allow current to flow through the excimer bulb and an off state; and a controller coupled to the first transistor, the second transistor, the third transistor, and the fourth transistor and configured to control operation of the first transistor, the second transistor, the third transistor, and the fourth transistor to power the excimer bulb; and wherein the controller is further coupled to the first resistor and the second resistor and is further configured to control operation of the first transistor and the second transistor based on electrical properties detected at the first resistor and the second resistor.

* * * * *